US010128563B2

(12) United States Patent
Lin

(10) Patent No.: US 10,128,563 B2
(45) Date of Patent: Nov. 13, 2018

(54) WIRELESS COMMUNICATION DEVICE

(71) Applicant: WISTRON NEWEB CORPORATION, Hsinchu (TW)

(72) Inventor: Chih-Chuan Lin, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 23 days.

(21) Appl. No.: 15/407,343

(22) Filed: Jan. 17, 2017

(65) Prior Publication Data

US 2018/0205139 A1 Jul. 19, 2018

(51) Int. Cl.

| | |
|---|---|
| ***H01Q 1/48*** | (2006.01) |
| ***H01Q 1/24*** | (2006.01) |
| ***H01Q 1/22*** | (2006.01) |
| ***H01Q 15/14*** | (2006.01) |

(52) U.S. Cl.

CPC ..... *H01Q 1/246* (2013.01); *H01Q 1/2291* (2013.01); *H01Q 1/48* (2013.01); *H01Q 15/14* (2013.01)

(58) Field of Classification Search

CPC ..... H01Q 1/246; H01Q 1/2291; H01Q 1/48; H01Q 15/14

USPC ..... 343/702

See application file for complete search history.

(56) References Cited

U.S. PATENT DOCUMENTS

2015/0255860 A1* 9/2015 Lienau ..... H01Q 1/273 343/702

* cited by examiner

*Primary Examiner* — Andrea Lindgren Baltzell

(74) *Attorney, Agent, or Firm* — Li & Cai Intellectual Property (USA) Office

(57) ABSTRACT

A wireless communication device includes a base, a first antenna module, and a second antenna module. The base has a first bearing surface and a second bearing surface disposed opposite to the first bearing surface. The first antenna module is disposed on the first bearing surface. The second antenna module is disposed on the second bearing surface. Upon the structure of the wireless communication device, the dissipation efficiency and signal transmission/reception performance generated by the antenna of the wireless communication device can be improved.

20 Claims, 10 Drawing Sheets

WIRELESS COMMUNICATION DEVICE

BACKGROUND OF THE INVENTION

1. Field of the Invention

The present disclosure relates to a wireless communication device, and more particularly to the structure and functionality of the wireless communication device.

2. Description of Related Art

Conventionally, nonmetallic materials are commonly applied to the outer cases of wireless base stations for receiving antennas. Those wireless base stations are advantageous to the penetration of the wireless signals generated by the antennas. However, overheating problems may arise because of the lack of thermal conduction of the nonmetallic materials used in the wireless base stations. In general, the antennas of those are usually arranged on a same plane, so that a large area of that plane will be occupied. Moreover, the antennas are not arranged by their types, resulting in inefficiency of signal transmission/reception performance.

SUMMARY OF THE INVENTION

One aspect of the present disclosure is to provide a wireless communication device that includes a base, a first antenna module, and a second antenna module. The base has a first bearing surface and a second bearing surface disposed opposite to the first bearing surface. The first antenna module is disposed on the first bearing surface. The second antenna module is disposed on the second bearing surface.

Another aspect of the present disclosure is to provide a wireless communication device including a base, a first antenna module, a second antenna module, a first housing, and a second housing. The base has a first bearing surface and a second bearing surface disposed opposite to the first bearing surface. The first antenna module is disposed on the first bearing surface. The second antenna module is disposed on the second bearing surface. The first housing is disposed on the base to cover the first antenna module. The second housing is disposed on the base to cover the second antenna module. The base has a heat dissipation surface exposed to the outside of the first housing and the second housing.

To summarize the above, the embodiments of the present disclosure provide a wireless communication device utilizing the arrangement of a base, a first antenna module, and a second antenna module, to improve the dissipation efficiency and signal transmission/reception performance generated by the antenna of the wireless communication device.

Further features of the invention, its nature and various advantages will be more apparent from the accompanying drawings and the following detailed description of the preferred embodiments.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

The structure and technical features of the present invention will now be described in considerable detail with reference to some embodiments and the accompanying drawings thereof, so that the present invention can be easily understood.

Figure 1:
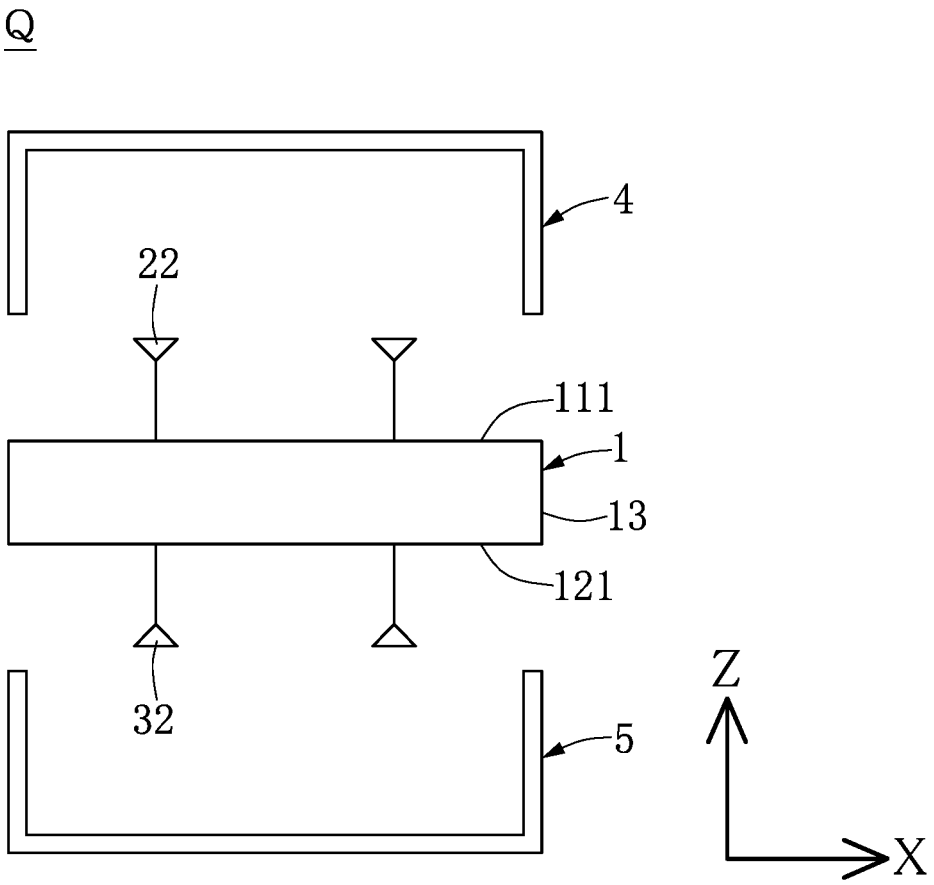
FIG. 1 shows an exploded schematic view of a wireless communication device according to an embodiment of the present invention.
Figure 2:
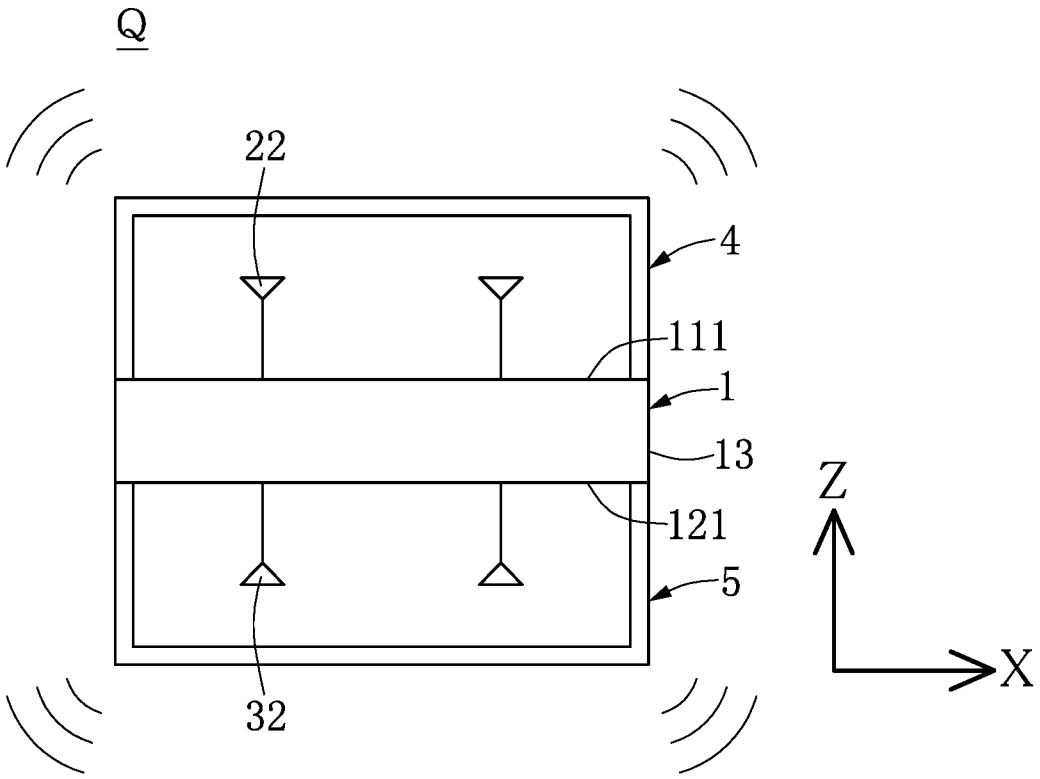
FIG. 2 shows a schematic view of a wireless communication device according to an embodiment of the present invention.

FIG. 1 is an exploded schematic view and FIG. 2 is a schematic view of a wireless communication device according to an embodiment of the present invention. The following is a description of the main concept of the present invention. An embodiment of the present invention provides a wireless communication device Q. The wireless communication device has a base 1, a first antenna unit 22, and a second antenna unit 32. The base 1 has a first bearing surface 111 and a second bearing surface 121 disposed opposite to the first bearing surface 111. For example, the first bearing surface 111 and the second bearing surface 121 may be opposite surfaces respectively located on the opposite sides of the base 1. Namely, the first bearing surface 111 and the second bearing surface 121 are the upper surface and the lower surface of the base 1, respectively. In addition, the first antenna unit 22 may be disposed on the first bearing surface 111, and the second antenna unit 32 may be disposed on the second bearing surface 121. The first antenna unit 22 and the second antenna unit 32 may be electrically connected to a circuit board (figure not shown) to receive or transmit a first electromagnetic signal of a first antenna unit 22 and a second electromagnetic signal of a second antenna unit 32, respectively. It is worth mentioning that the first antenna element 22 and the second antenna element 32 may have different operating frequencies.

It should be noted that the first bearing surface 111 and the second bearing surface 121 of the base 1 are reflective surfaces providing reflections of signals transmitted from the antenna units 22 and 32, thereby improving their overall gains (Gain). That is, in some embodiments, the first bearing surface 111 is a first reflective surface for reflecting a first electromagnetic signal generated by the first antenna unit 22, and the second bearing surface 121 is a second reflective surface for reflecting a second electromagnetic signal generated by the second antenna unit 32. In another embodiment, if the first antenna unit 22 includes a Global Positioning System (GPS) antenna, it may increase the reception efficiency and the gain of the electromagnetic signal received or transmitted along the vertical direction (Z direction) via the first reflective surface.

Referring to FIG. 1 and FIG. 2, in one embodiment, the wireless communication device Q further includes a first housing 4 and a second housing 5, and the base 1 further has an exposed surface 13 located between the first housing 4 and the second housing 5 and exposed to the outside of the first housing 4 and the second housing 5. Particularly, the exposed surface 13 of the base 1 is an annular surface surrounding the periphery of the base 1, and the exposed surface 13 is a heat dissipating surface for improving heat dissipation efficiency. Furthermore, the first housing 4 may be disposed on the base 1 to cover the first antenna unit 22, and the second housing 5 may be disposed on the base 1 to cover the second antenna unit 32.

As shown in FIG. 2, in one embodiment, the base 1 is made of metal in order to enhance heat dissipation efficiency and shielding noise. At the same time, the base 1 made of metal may also avoid interference between the first antenna unit 22 and the second antenna unit 32. The first housing 4 and the second housing 5 are made of a nonmetal material so that the first electromagnetic signal and the second electromagnetic signal can penetrate the first housing 4 and the second housing 5, respectively. For example, the material of the base 1 is made of aluminum, and the material of the first housing 4 and the second housing 5 is plastic. However, the present invention is not limited thereto.

Figure 3:
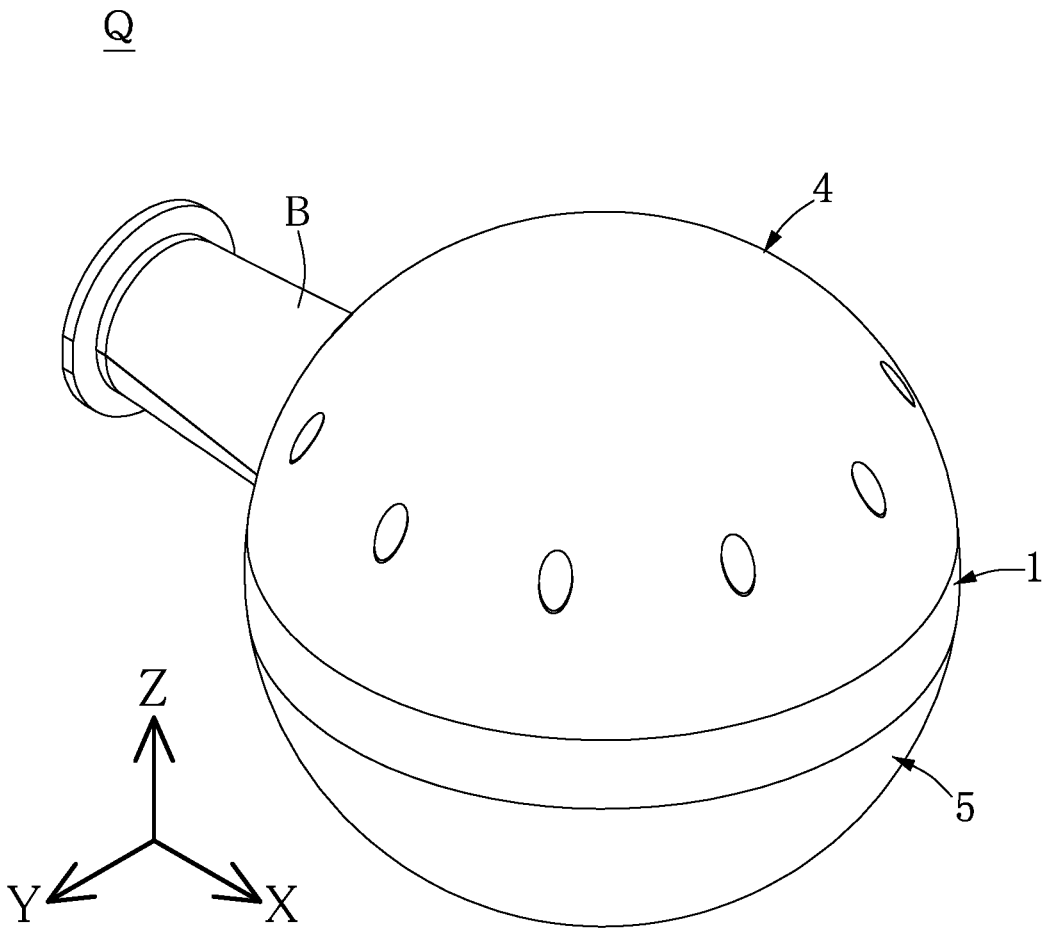
FIG. 3 shows a perspective view of the wireless communication device according to an embodiment of the present invention.
Figure 4:
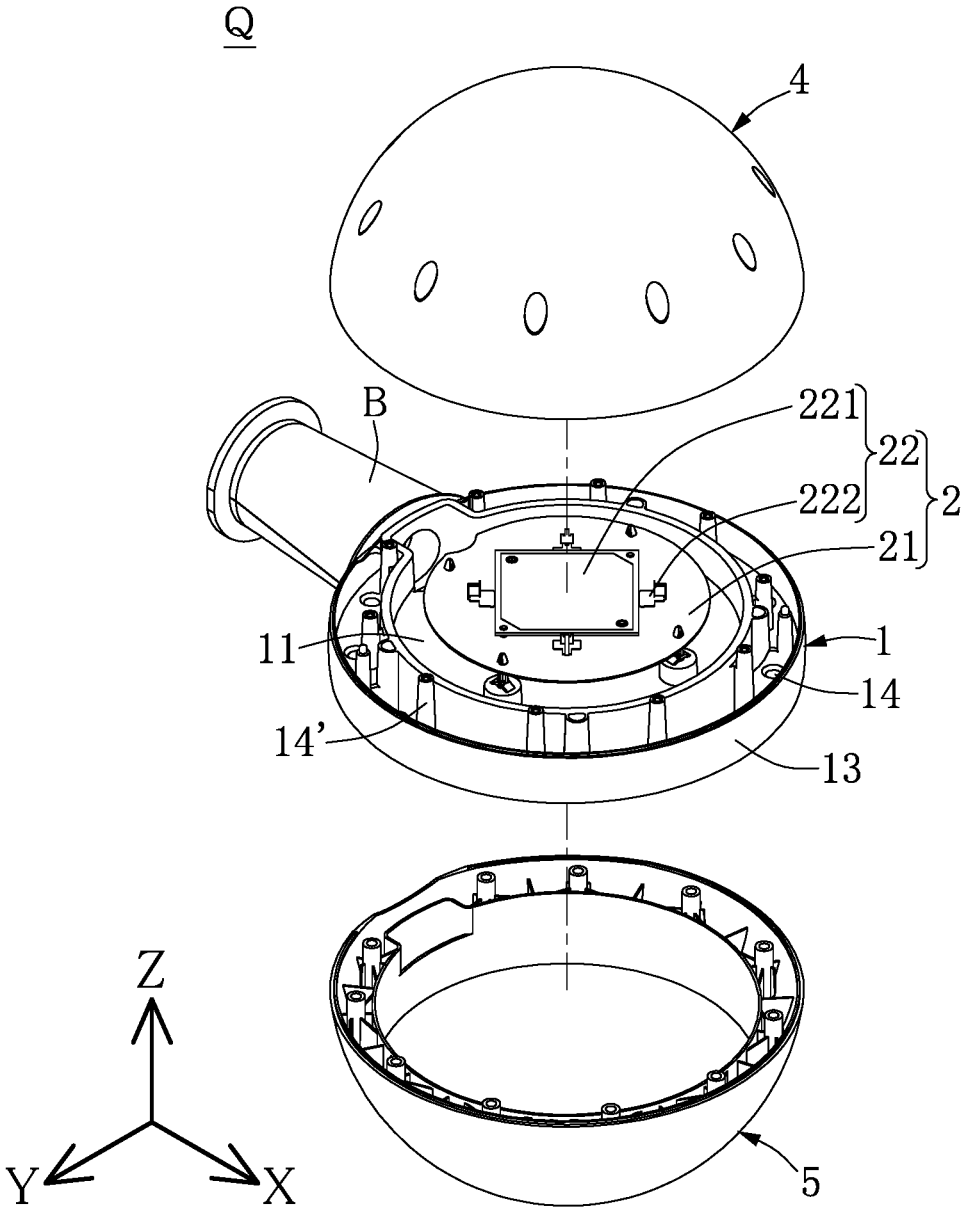
FIG. 4 shows an exploded view of the wireless communication device according to the embodiment of the present invention.
Figure 5:
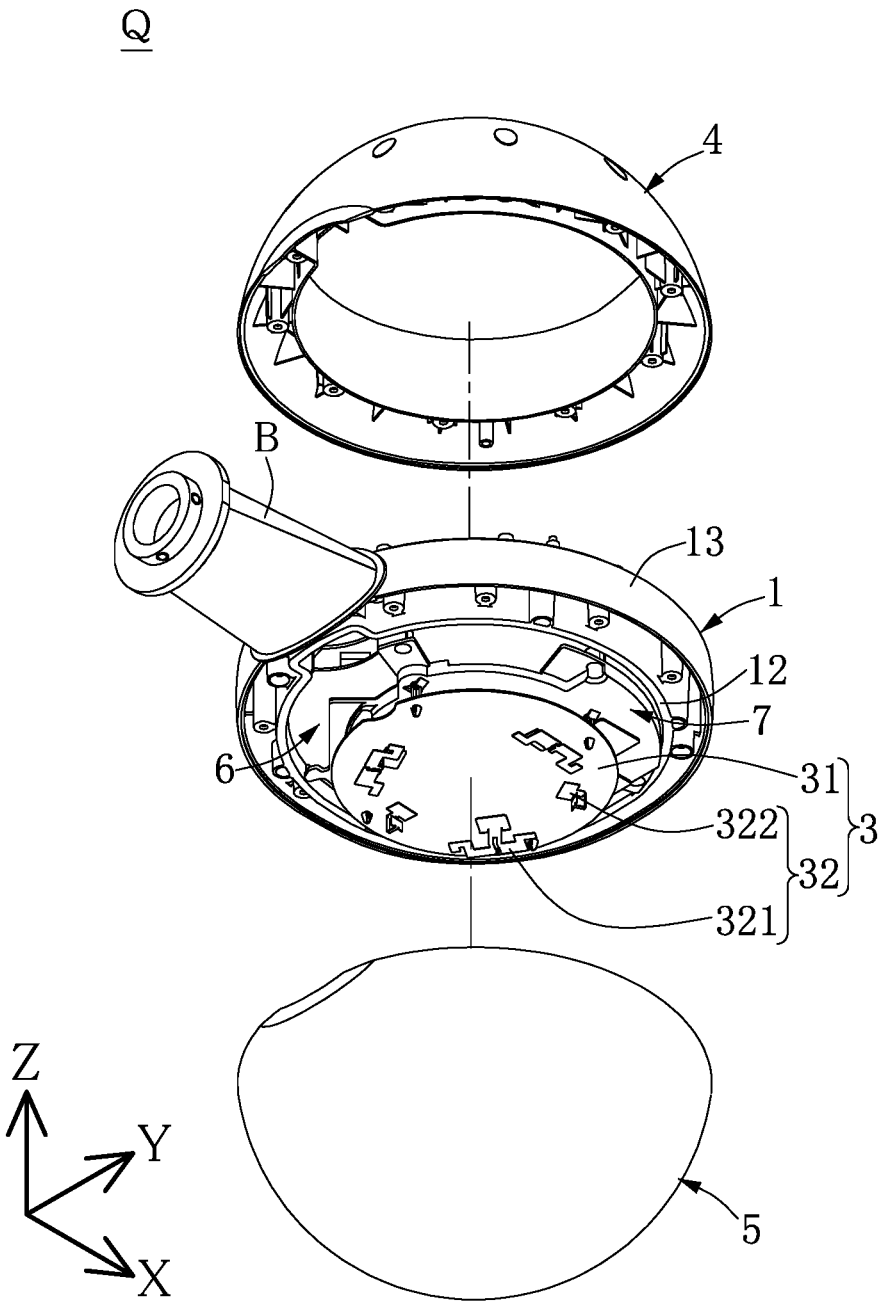
FIG. 5 shows an exploded view of the wireless communication device shown in FIG. 4 from another perspective.

FIG. 3 is a perspective view and FIG. 4 is an exploded view illustrating the wireless communication device according to an embodiment of the present invention. FIG. 5 is an exploded view of the wireless communication device shown in FIG. 4 from another perspective. The following description will be made as to a further embodiment. The wireless communication device Q may have a base 1, a first antenna module 2, a second antenna module 3, a first housing 4, and a second housing 5 separated from the first housing 4 from each other. In addition, the first housing 4 and the second housing 5 may be fixed to the fixing portion 14 of the base 1 by a lock element or an engaging member such as a screw or the like (figure not shown). The exposed surface 13 of the base 1 may be exposed to the outside of the overall structure of the wireless communication device Q. For instance, as shown in FIG. 4 and FIG. 5, a plurality of lock elements may respectively pass through the fixing portion 14 of the base 1 and can be engaged with screw holes (not shown) formed around the second housing 5, so that the second housing 5 is fixed to the base 1. Similarly, a plurality of lock elements may pass through a plurality of holes (not shown) provided by the first housing 4 and engage with the fixing portion 14' provided on the base 1, so that the first housing 4 can be fixed to the base 1. However, the present invention is not limited thereto. In other embodiments, the first housing 4 and the second housing 5 may be fixed to the base 1 by any adhesive means (not shown).

It is worth to be mentioned that both the first antenna module 2 and the second antenna module 3 are heat sources which generates heat. By respectively disposing the antenna modules 2 and 3 on the upper surface and the lower surface of the base 1, the heat sources are separated and discrete, thereby enhancing heat dissipation during operation. Accordingly, in some embodiments, the exposed surface 13 of the base 1 may also be placed inside the housings 4 and 5. Nevertheless, having the exposed surface 13 exposed outside the housings 4 and 5 is more preferable due to better heat dissipation efficiency while the exposed surface 13 is exposed to air in an open environment.

Referring to FIG. 4 and FIG. 5, the base 1 may have a first bearing structure 11 and a second bearing structure 12 opposite to the first bearing structure 11. For example, the first antenna module 2 and the second antenna module 3 may be fixed to the first bearing structure 11 and a second bearing structure 12, respectively, via a fixing member F (e.g., a fastening structure or a screw, see FIGS. 6 and 7); however, the present invention is not limited thereto. Also, for example, the first antenna module 2 includes a first reflective plate 21 and a first antenna unit 22 disposed on the first reflective plate 21, and the second antenna module 3 includes a second reflective plate 31 and a second antenna unit 32 disposed on the second reflective plate 31.

In one embodiment, the first antenna unit 22 may include a first antenna 221 and a second antenna 222, and the first antenna 221 of the first antenna unit may be a global positioning system antenna having an operating frequency range between 1.57 GHz and 1.58 GHz, and the second antenna 222 of the first antenna unit 22 may be a Wireless Fidelity (Wi-Fi) antenna having an operating frequency range between 5.15 GHz to 5.85 GHz, however, the present invention is not limited thereto. In addition, the second antenna unit 32 may include a first antenna 321 and a second antenna 322. The first antenna 321 of the second antenna unit 32 may be a wireless fidelity antenna having an operating frequency range between 5.15 GHz to 5.85 GHz. The second antenna 322 of the second antenna unit 32 may be a wireless fidelity antenna having an operating frequency range between 2.412 GHz to 2.4835 GHz. In other embodiments, the second antenna unit 32 may also include a Bluetooth antenna (not shown), and/or a Zigbee short-range wireless transmission module (not shown). In addition, the above-mentioned wireless fidelity antenna may conform to the specifications such as IEEE 802.11a, IEEE 802.11b, IEEE802.11g, IEEE802.11n and/or IEEE802.11ac and the like in the Institute of Electrical and Electronics Engineers. Furthermore, for example, a 5.15 GHz to 5.85 GHz wireless fidelity antenna may be a planar inverted-F antenna, and a 2.412 GHz to 2.4835 GHz wireless fidelity antenna may be a Dipole antenna. The global positioning system antenna may be a patch antenna. However, the present invention is not limited thereto, and in other embodiments, the antenna may be configured as required.

Figure 6:
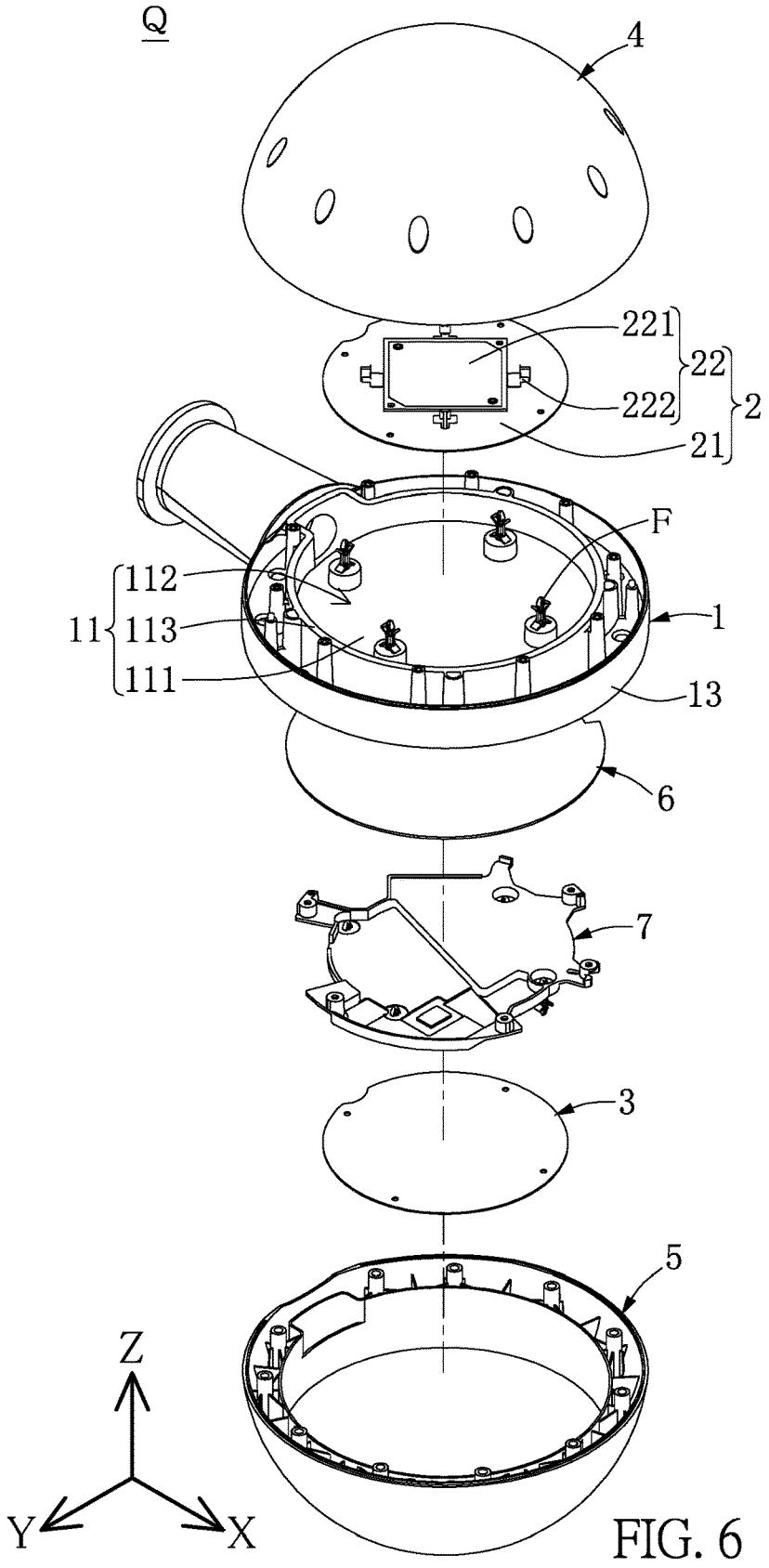
FIG. 6 shows an exploded view of the wireless communication device according to an embodiment of the present invention.
Figure 7:
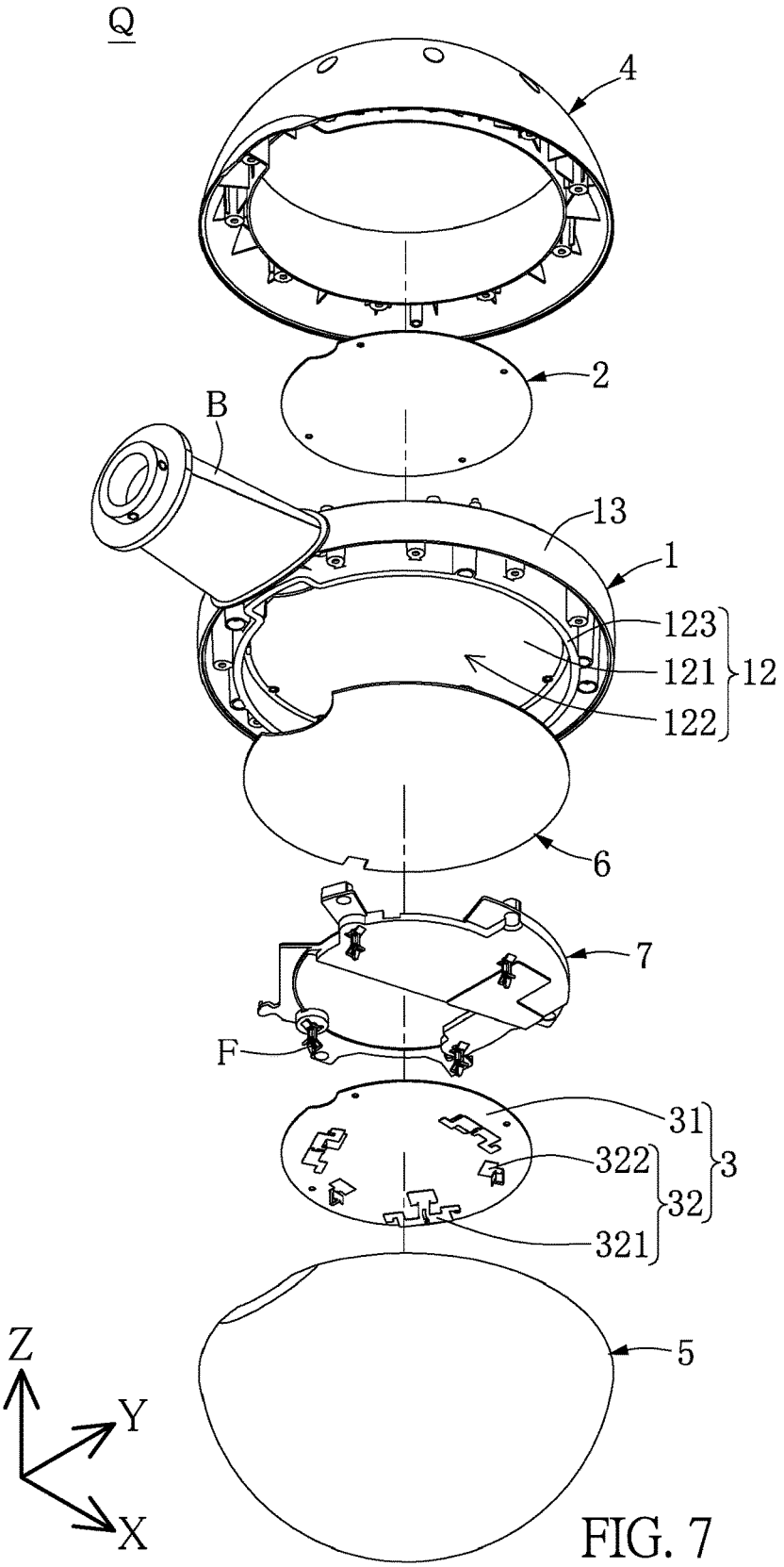
FIG. 7 shows an exploded view of the wireless communication device shown in FIG. 6 from another perspective.

FIG. 6 and FIG. 7 are exploded perspective views of the wireless communication device with respect to FIG. 3 and FIG. 4, respectively. In detail, the first bearing structure 11 and the second bearing structure 12 may include a first wall 113 and a second wall 123 disposed along the periphery of the first bearing surface 111 and the second bearing surface 121, respectively The first antenna module 2 and the second antenna module 3 can be disposed in the first recess 112 and the second recess 122, respectively. The disposition of the first recess 112 and the second recess 122 can provide more space for accommodating the first antenna module 2 and the second antenna module 3 and achieve either cost or weight reduction.

Referring to FIG. 6 and FIG. 7, the wireless communication device Q may further include a circuit board 6. The circuit board 6 may be disposed on the base 1, and the first antenna module 2 and the second antenna module 3 may be electrically connected to the circuit board 6. In addition, the circuit board 6 has a processor or a control module (not shown) for controlling electromagnetic signals transmitted by the first antenna unit 22 and the second antenna unit 32. It should be noted that although the circuit board 6 is disposed on the second bearing surface 121 of the second bearing structure 12 in the illustrated embodiment of the present invention, in other embodiments, the circuit board 6 may be disposed on the first bearing surface of the first bearing structure 11 or disposed between the first antenna module 2 and the second antenna module 3. The present invention is not limited to where the circuit board 6 is specifically disposed. Further, in other embodiments, the first antenna module 2 and the second antenna module 3 may include a processor or a control module for controlling electromagnetic signals transmitted by the first antenna unit 22 and the second antenna unit 32, so that the circuit board 6 can be omitted.

Referring to FIG. 6 and FIG. 7, the wireless communication device Q may further include a fixing base 7. The circuit board 6 may be disposed between the base 1 and the fixing base 7. The circuit board 6 may be disposed on the base 1 through the fixing base 7. It should be noted that the material of the fixing base 7 may be made of metal, thereby protecting the circuit board 6 from deformation, and further increases the overall heat dissipation efficiency of the wireless communication device Q. It is worth mentioning that the second antenna module 3 may also be fixed to the second bearing structure 12 through the fixing base 7. In this instance, the second antenna module 3 and the fixing base 7 can be fixed together by a fixing member F located therebetween via fastening, locking, etc. However, the present invention is not limited to the type of the fixing member F.

Since the circuit board 6 may be the most significant heat source in the wireless communication device Q, the circuit board 6 can be tightly attached to the base 1 and the fixing base 7. Due to the first bearing structure 11, the second bearing structure 12, and the exposed surface 13 of base 1 are integrally formed or connected each other, the heat generated by the circuit board 6 can therefore be sequentially transferred from the first bearing surface 111 or the second bearing surface 121 to the exposed surface 13 of the base 1.

Figure 8:
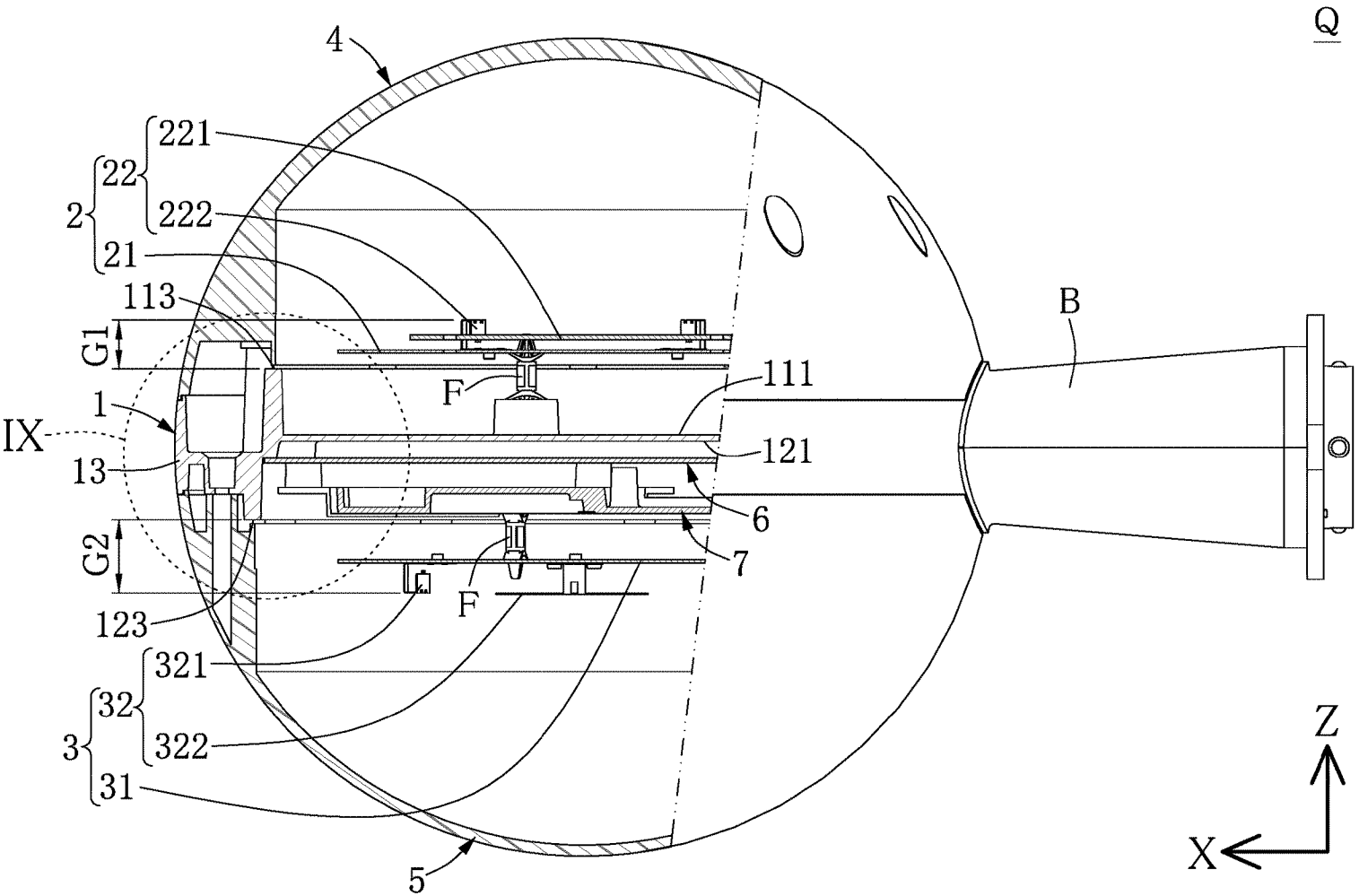
FIG. 8 shows a partial cross-sectional view of the wireless communication device according to an embodiment of the present invention.
Figure 9:
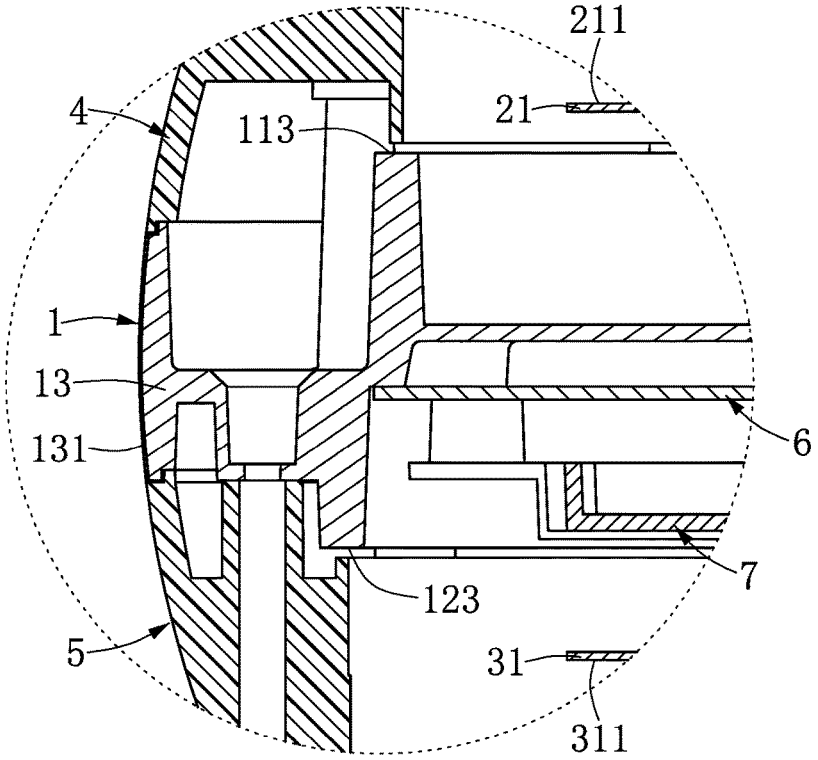
FIG. 9 shows a partially enlarged view of a portion IX of FIG. 8.

Referring to FIG. 8 and FIG. 9, the height of the first antenna unit 22 is taller than the height of the first wall 113 from the first bearing surface 111, and the height of the second antenna unit 32 is taller than the height of the second wall 123 from the second bearing surface 121. On the other hand, a first predetermined gap G1 may be provided between the first antenna unit 22 and the first wall 113, and a second predetermined gap G2 may be provided between the second antenna unit 32 and the second wall 123. The first antenna unit 22 and the second antenna unit 32 can be elevated by a plurality of fixing members F, respectively, so as to prevent the first antenna unit 22 and the second antenna unit 32 from being shielded by the first walls 113 and the second wall 123 because the first walls 113 and the second wall 123 affects the antenna efficiency. The exposed surface 13 of the base 1 may also have a coating layer 131, which may be a painted layer, preferably in a dark or black color. In addition, the coating layer 131 may be a material having a heat radiation effect.

Figure 10:
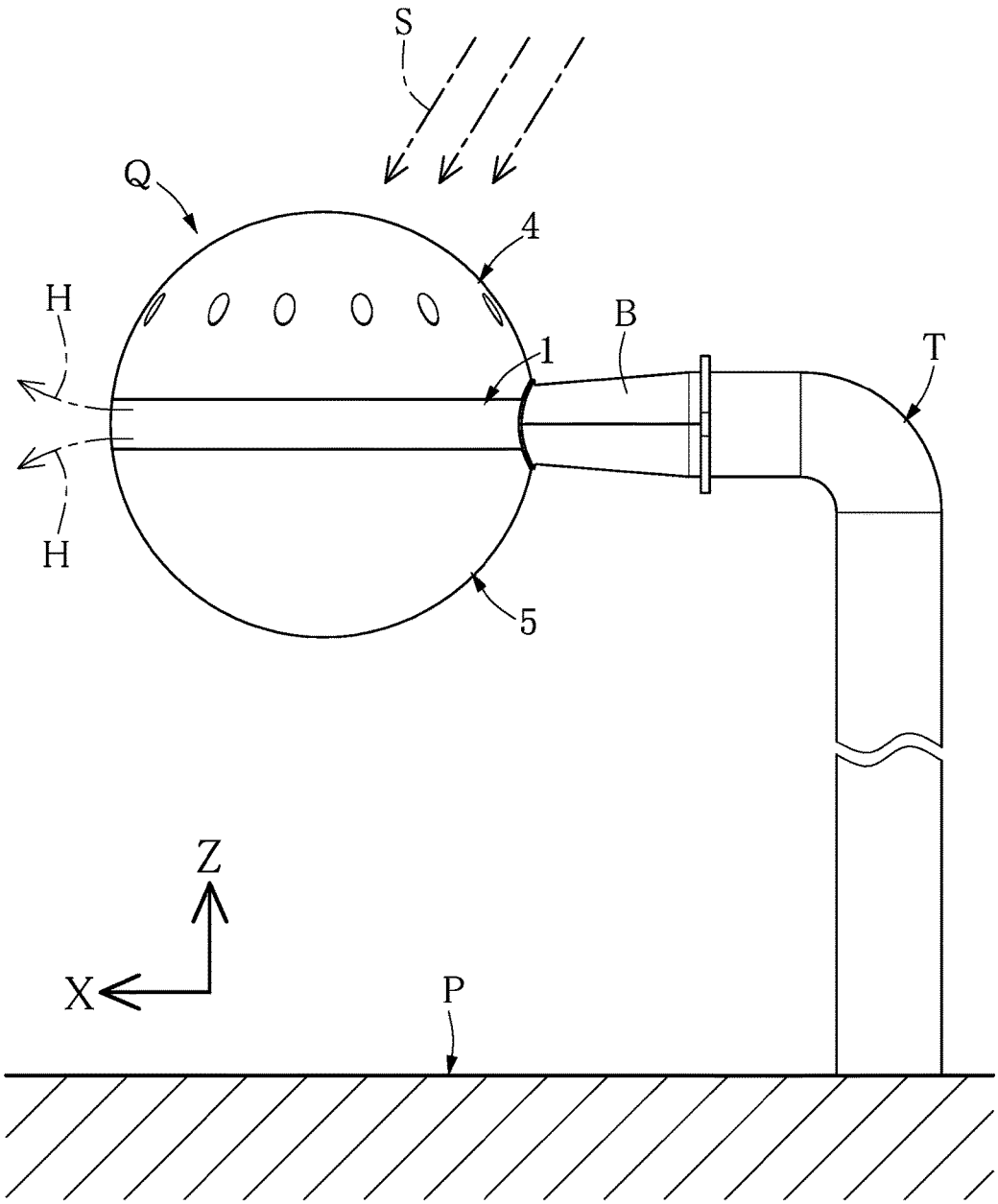
FIG. 10 shows a schematic diagram illustrating a state of use of a radio communication device according to an embodiment of the present invention.

Referring to FIG. 8 and FIG. 10, the wireless communication device Q may further include a positioning base B connected to the base 1. The positioning base B is connected to a support T. The support T may be disposed on the ground P such that the wireless communication device Q and the ground P are separated by a predetermined distance and the first bearing surface 111 or the second bearing surface 121 is substantially parallel to the ground P. The first antenna unit 22 can be arranged in a direction Z (vertical to the horizontal plane or the ground P), and the second antenna unit 32 can face in a direction opposite to the direction Z. Thus, in one embodiment, the first antenna unit 22 disposed on the first bearing surface 111 may preferably be used to link two wireless communication devices Q in the range of 50 meters to 300 meters of a Wireless Mesh Network (WMN) and used to receive GPS signal. In addition, the second antenna unit 32 disposed on the second bearing surface 121 may preferably be used to provide a Wi-Fi antenna having an operating range between 5.15 GHz to 5.85 GHz or 2.412 GHz to 2.4835 GHz to provide a WiFi service to users around the wireless communication device Q, such as a mobile phone, a tablet, a notebook computer, or the like, for example, within a range of 100 meters)

Referring to FIG. 8 and FIG. 10, the heat generated by the first antenna module 2 and/or the second antenna module 3 (or the heat generated by the circuit board 6) can be transferred along the first bearing surface 111 or the second bearing surface 121 to the exposed surface 13 (heat dissipating surface 13) of the base 1.

The radiation patterns of the first antenna unit 22 and the second antenna unit 32 are reflected by the first reflective plate 21 (or the first reflective surface) and the second reflective plate 31 (or the second reflective surface) to enhance the efficiency of the antenna to transmit and receive signals. Further, the arrangement of the first reflective plate 21 (or the first reflective surface) and the second reflective plate 31 (or the second reflective surface) can improve the gain of the first antenna unit 22 in X-Y plane and in the vertical direction (+Z-axis direction), and the gain of the second antenna element 32 in X-Y plane and in the vertical direction (−Z-axis direction).

As shown in FIG. 10, the wireless communication device Q according to the embodiment of the present invention may be a wireless access point applied to outdoor units. During daylight such as noon, strong sunlight S will likely irradiate onto the wireless communication device Q; since the first housing 4 and the second housing 5 are made of a nonmetallic material, overheating problems caused by direct sunlight S is more likely to be prevented. Further, since the base 1 is made of metal, the exposed surface 13 of the base 1 can quickly dissipate the heat H of the wireless communication device Q to the external environment. However, it should be noted that the wireless communication device Q provided by the present invention can also be applied to indoor environments.

The foregoing is merely illustrative of the principles of this invention and various modifications can be made by those skilled in the art without departing from the scope and spirit of the invention.

Although the present invention has been described in considerable detail with reference to certain preferred embodiments thereof, other embodiments are possible. Therefore, their spirit and scope of the appended claims should not be limited to the description of the preferred embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wireless communication device, comprising:

a base having a first bearing surface and a second bearing surface disposed opposite to the first bearing surface;

a first antenna module disposed on the first bearing surface;

a second antenna module disposed on the second bearing surface;

a first housing disposed on the base to entirely cover the first antenna module;

a second housing disposed on the base to entirely cover the second antenna module, wherein the first housing and the second housing are separated from each other; and a circuit board disposed on the base, wherein the first antenna module and the second antenna module are electrically connected to the circuit board;

wherein the base further comprises an exposed surface located between the first housing and the second housing and exposed to the outside of the first housing and the second housing; and wherein the exposed surface is exposed to air in an open environment, and the first housing and the second housing are exposed to the air in the open environment.

2. The wireless communication device of claim 1, further comprising a positioning base and a support, the positioning base is connected to the base and the support, wherein the support is disposed on a ground, the first bearing surface is substantially parallel to the ground.

3. The wireless communication device of claim 2, wherein the first antenna module includes a Global Positioning System antenna.

4. The wireless communication device of claim 1, wherein the exposed surface has a coating layer.

5. The wireless communication device of claim 1, wherein the circuit board is disposed between the first antenna module and the second antenna module, and the heat generated by the circuit board is transferred to the exposed surface of the base along the first bearing surface or the second bearing surface.

6. The wireless communication device of claim 1, wherein the base is made of metal, and the first housing and the second housing are made of nonmetal material.

7. The wireless communication device of claim 1, wherein the base further comprises a first wall and a second wall disposed along the periphery of the first bearing surface and the second bearing surface respectively, wherein a first recess is defined by the first wall and the first bearing surface, and a second recess is defined by the second wall and the second bearing surface.

8. The wireless communication device of claim 7, wherein the first antenna module includes a first reflective plate and a first antenna unit disposed on the first reflective plate, and the second antenna module includes a second reflective plate and a second antenna unit disposed on the second reflective plate.

9. The wireless communication device of claim 8, wherein the height of the first antenna unit is taller than the height of the first wall from the first bearing surface, and the height of the second antenna unit is taller than the height of the second wall from the second bearing surface.

10. The wireless communication device of claim 9, wherein the first antenna unit comprises a global positioning system antenna and a first wireless fidelity antenna, and the second antenna unit comprises a second wireless fidelity antenna.

11. The wireless communication device of claim 1, wherein the first antenna module comprises a global positioning system antenna and a first wireless fidelity antenna, and the second antenna module comprises a second wireless fidelity antenna.

12. The wireless communication device of claim 1, wherein the first bearing surface is a first reflective surface adapted to be reflecting a first electromagnetic signal generated by the first antenna module, and the second bearing surface is a second reflective surface adapted to be reflecting a second electromagnetic signal generated by the second antenna module.

13. A wireless communication device, comprising:

a base having a first bearing surface and a second bearing surface disposed opposite to the first bearing surface;

a first antenna module disposed on the first bearing surface;

a second antenna module disposed on the second bearing surface;

a first housing disposed on the base to cover the first antenna module and the first bearing surface; and a second housing disposed on the base to cover the second antenna module and the second bearing surface;

wherein the base further comprises an exposed surface located between the first housing and the second housing and exposed to the outside of the first housing and the second housing;

wherein the exposed surface is exposed to air in an open environment, and the first housing and the second housing are exposed to the air in the open environment;

wherein the first antenna module includes an first operating frequency band, the second antenna module includes a second operating frequency band, the first operating frequency band is different from the second operating frequency band.

14. The wireless communication device of claim 13, wherein the base is made of metal, and the first housing and the second housing are made of nonmetal material.

15. The wireless communication device of claim 13, wherein the first antenna module comprises a global positioning system antenna and a first wireless fidelity antenna, and the second antenna module comprises a second wireless fidelity antenna.

16. The wireless communication device of claim 13, wherein the heat generated by the first antenna module or the second antenna module is transferred to the exposed surface of the base along the first bearing surface or the second bearing surface.

17. The wireless communication device of claim 13, wherein the first bearing surface and the second bearing surface are substantially parallel to a ground surface.

18. The wireless communication device of claim 13, further comprising a positioning base and a support, the positioning base is connected to the base and the support, wherein the support is disposed on a ground, the first bearing surface is substantially parallel to the ground.

19. The wireless communication device of claim 18, wherein the first antenna module includes a Global Positioning System antenna.

20. The wireless communication device of claim 13, wherein the first antenna module includes a first reflective plate and a first antenna unit disposed on the first reflective plate, the second antenna module includes a second reflective plate and a second antenna unit disposed on the second reflective plate; wherein a first radiation pattern of the first antenna unit is reflected by the first reflective plate to improve the gain of the first antenna unit in a first direction, a second radiation pattern of the second antenna unit is reflected by the second reflective plate to improve the gain of the second antenna unit in a second direction, the first direction and the second direction are opposite to each other.

* * * * *